US007134150B2

(12) United States Patent
Stewart

(10) Patent No.: US 7,134,150 B2
(45) Date of Patent: Nov. 14, 2006

(54) FOOT-OPERATED TOILET SEAT

(76) Inventor: Steve Stewart, 12300 Wilshire Blvd. #300, Los Angeles, CA (US) 90025

( * ) Notice: Subject to any disclaimer, the term of this patent is extended or adjusted under 35 U.S.C. 154(b) by 0 days.

(21) Appl. No.: 10/721,515

(22) Filed: Nov. 24, 2003

(65) Prior Publication Data

US 2004/0103470 A1 Jun. 3, 2004

Related U.S. Application Data

(60) Provisional application No. 60/428,672, filed on Nov. 25, 2002.

(51) Int. Cl.
*A47K 13/10* (2006.01)

(52) U.S. Cl. ..... 4/246.3; 4/248

(58) Field of Classification Search ..... 4/246.1, 4/246.3, 246.4, 246.5, 248
See application file for complete search history.

(56) References Cited

U.S. PATENT DOCUMENTS 1,863,682 A * 6/1932 Alberts ..... 4/246.3
2,042,276 A * 5/1936 Revers ..... 4/246.3
2,705,330 A * 4/1955 Knudsen ..... 4/246.1
4,103,371 A 8/1978 Wilson ..... 4/246.2
5,014,367 A 5/1991 Gamblin ..... 4/246.2
5,404,595 A 4/1995 Carmel ..... 4/246.1
5,444,877 A * 8/1995 Kumarasurier ..... 4/246.1
5,448,782 A 9/1995 Ratajac ..... 4/246.5
6,112,335 A 9/2000 Gaston ..... 4/246.1

* cited by examiner

*Primary Examiner*—Robert M. Fetsuga
(74) *Attorney, Agent, or Firm*—Charles Rattner

(57) ABSTRACT

A mechanism for raising a toilet seat includes two geared shafts that are cooperatively engaged while mounted on a toilet. A foot-operated lever attached to a first of the geared shafts provides torque thereto, causing a rotation of the first geared shaft upon depressing the lever. This, in turn, causes a rotation of the second of the geared shafts. The second geared shaft includes a metal flange or other connector that secures a toilet seat thereto over the bowl of the toilet. As the two geared shafts rotate, the toilet seat raises and lowers with the movement of the metal flange on the second geared shaft.

15 Claims, 3 Drawing Sheets

FOOT-OPERATED TOILET SEAT

CROSS-REFERENCE TO RELATED APPLICATIONS

The present application claims priority under 35 U.S.C. §119(e) to U.S. Provisional Patent Application Ser. No. 60/428,672 entitled FOOT OPERATED TOILET SEAT filed in the name of Steve Stewart on Nov. 25, 2002, the entirety of which is incorporated herein by reference.

FIELD OF THE INVENTION

The present disclosure relates to a toilet seat adjusting mechanism for residential or commercial toilets, and more specifically relates to a foot-operated mechanism for raising a toilet seat that results in improved sanitation and convenience to all users of the toilet.

BACKGROUND OF THE INVENTION

Most toilets in the developed western world have a seat. The typical seat is a moveable device, to be manually lifted when using the toilet as a urinal. Seat design, however, has never favored this fact, and it is very common to this day to fumble for a finger-hold on the bottom edge of toilet seats in both public and residential bathrooms in order to lift them to the raised position. This is both unsanitary and inconvenient.

Other numerous attempts to produce a commercially viable toilet seat lifting device have encompassed designs that are ungainly or involve mechanisms that require considerable manufacturing cost and complexity and user maintenance. U.S. Pat. No. 4,103,371 to Wilson, U.S. Pat. No. 5,014,367 to Gamblin, U.S. Pat. No. 5,448,782 to Ratajac and U.S. Pat. No. 6,112,335 to Gaston all involve hydraulic and pneumatic cylinders and complicated levers and linkages necessitating manufacturing complexity and undue expense, along with user assembly and maintenance issues associated with hydraulic and pneumatic designs. U.S. Pat. No. 5,404,595 to Carmel involves two levers, a floor-mounted base and numerous linkages, as well as an electrical motor option to lift the seat. This too, is overly complex to manufacture and difficult for the end user to install and maintain.

SUMMARY OF THE INVENTION

The present disclosure provides a simple, easy to manufacture, and cost effective solution to the age-old problem of lifting the toilet seat in order to use the toilet as a urinal in a sanitary and convenient manner. The present disclosure will overcome this problem by utilizing a very simple foot-operated mechanism to lift the seat while using the toilet as a urinal. It can be inexpensively mass produced and can be easily fitted to new and existing popular toilet models.

Instead of fumbling for a finger-hold around the bottom of the toilet seat, a foot-operated device is more convenient and keeps a user's hands away from the toilet bowl. Using a robust two geared shaft design and a single lever, this invention can be installed quickly on new toilets, and can easily replace or supplement conventional toilet seats on popular existing toilet models.

The present disclosure is operated by means of a mechanical assembly near the rear base of the toilet seat, mounted near the rear edge of the toilet bowl, in front of the toilet tank, and consisting of a pair of geared shafts, one attached to the toilet seat and the other attached to an adjustable lever that extends down one side of the toilet bowl, at an angle, toward the floor, terminating in a foot pedal a few inches above the floor itself Downward pressure on the foot pedal causes the rear shaft to rotate toward the front of the toilet bowl, with the gearing then forcing the front shaft to rotate in the opposite direction. This front shaft is connected to the toilet seat at its rear base, causing it to lift up from the toilet bowl as the shaft is rotated. Its maximum travel is almost 90 degrees from the closed position, resulting in unfettered access to the toilet bowl. Releasing pressure on the pedal reverses the process, with gravity causing the seat to lower back into the horizontal position, resting on the toilet bowl. A set of friction bushings on each end of the front shaft can be adjusted to control the amount of resistance necessary for smooth operation in both raising and lowering the seat, and will eliminate the seat from being dropped too quickly into the lowered position. A toilet seat cover will ride on top of the toilet seat and will rise with the toilet seat from the pressure of the toilet seat rising beneath it and lower by force of gravity, resting on top of the toilet seat. The toilet seat cover may also be left in the open (upright) position by rotating it beyond 90 degrees from the toilet bowl (so it rests against the toilet tank) if so desired, with the toilet seat moving up and down independently.

The present disclosure will increase sanitation when using the toilet by eliminating the need to touch the toilet seat to raise it. It would also make it easier for young male children, the elderly, handicapped or those with bad backs to raise the toilet seat and will eliminate the need for men to hold the toilet seat in a raised position while urinating. The present disclosure would also serve to eliminate the common problem of male household members forgetting to put the toilet seat down after use.

The present disclosure overcomes the problems associated with prior technologies by retaining a simple design for both manufacturing and use. This simplicity equates to lower production costs (and thus, lower retail prices) and ease of installation and use by the consumer. The robust structure of the mechanism and the small number of moving parts involved translates into a high level of durability for the end user. The present disclosure is also easily retrofitted to existing toilets, and doesn't require special tools, electricity, drilling, floor-mounted brackets or floor-mounted pedals to install or use.

DETAILED DESCRIPTION OF THE PREFERRED EMBODIMENTS

Figure 1:
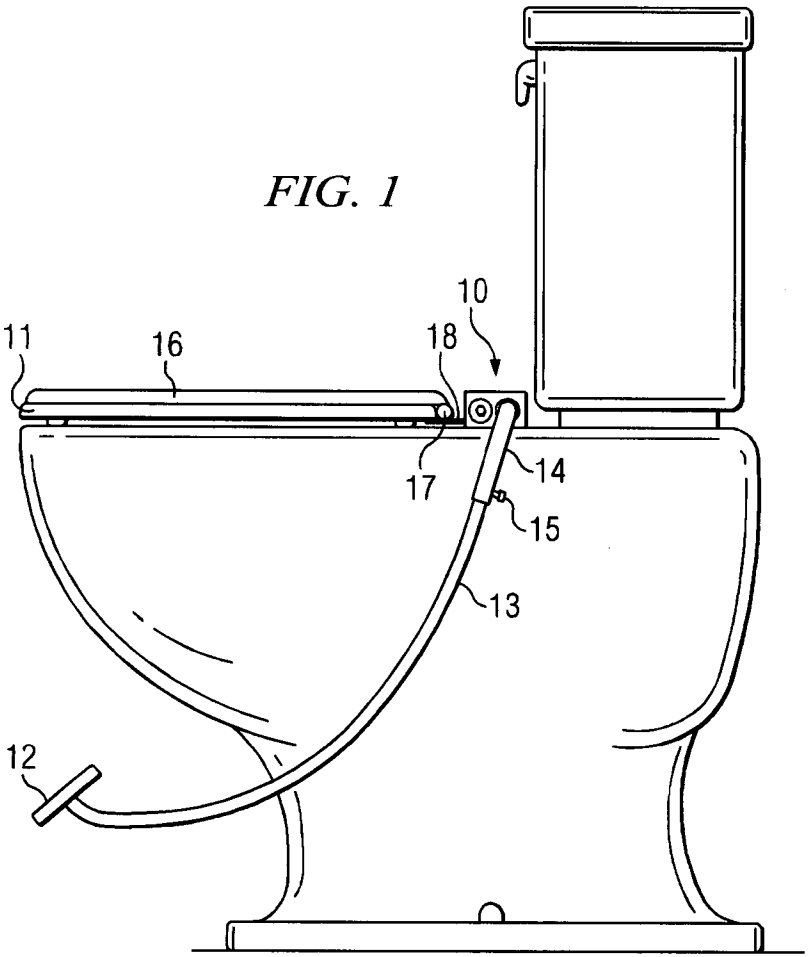
FIG. 1 is a side view of a foot-operated lever mounted on a typical toilet with the toilet seat in a lowered position.

Referring to FIG. 1, a foot-operated mechanism 10 is shown in a side perspective, mounted on a typical toilet, just in front of the tank, on the rear edge of the toilet bowl. In a lowered position, the toilet seat 11 rests on the edge of the toilet bowl, with the foot pedal 12 in a normal position above the floor. The lower lever 13 to which the foot pedal 12 is attached is slightly smaller in diameter than an upper lever 14, allowing for an adjusting friction screw 15 to be used to adjust the extension length of the lower lever 13, and thus the distance from the foot pedal 12 distance above the floor. A toilet seat cover 16 is mounted on a hinge 17 just to the rear of the toilet seat and on top of a metal flange 18.

Figure 2:
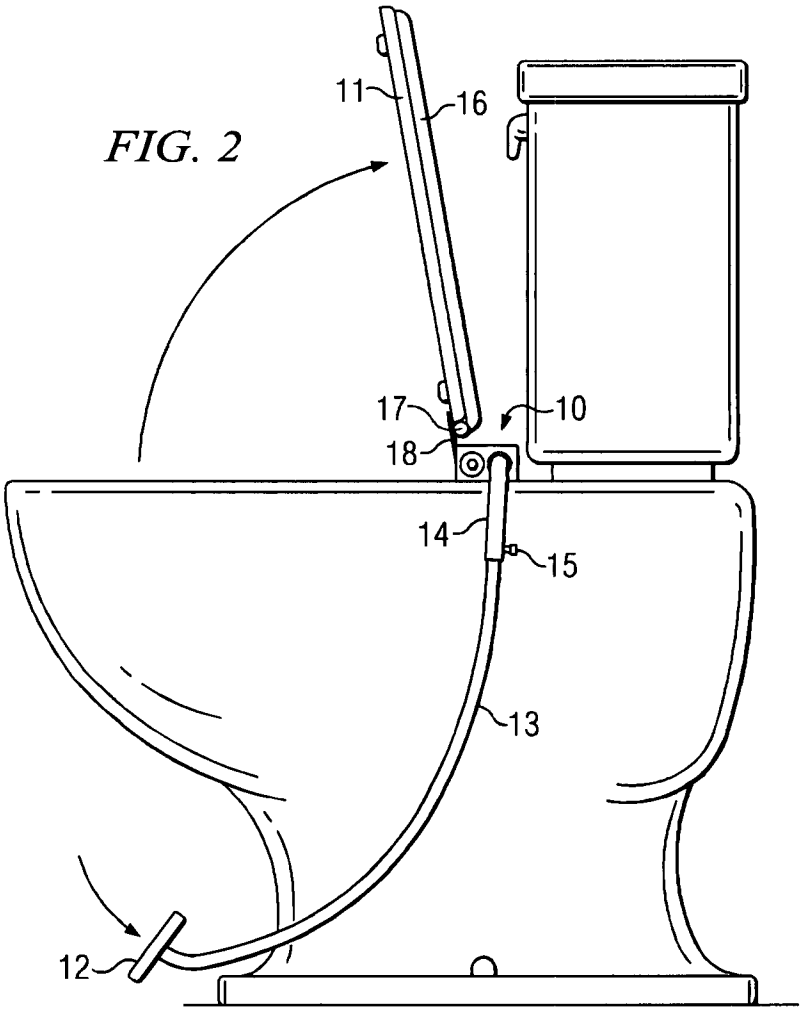
FIG. 2 is a side view of the foot-operated lever depressed to adjust the toilet seat to a raised position.

FIG. 2 depicts the foot-operated mechanism 10 shown in a side perspective with the toilet seat 11 in a raised position. Note that as the foot pedal 12 is depressed, the toilet seat 11 and toilet seat cover 16 are lifted into the raised position.

Figure 3:
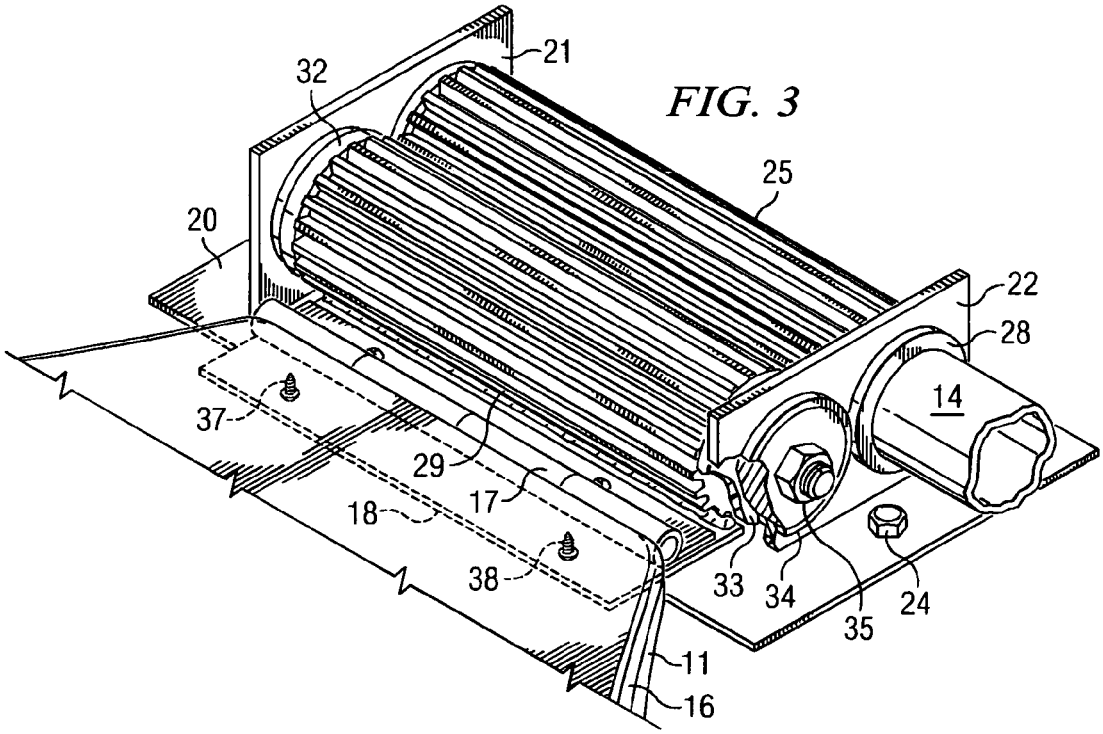
FIG. 3 is a perspective view of a mechanism for raising the toilet seat in response to a depression of the foot-operated lever.
Figure 4:
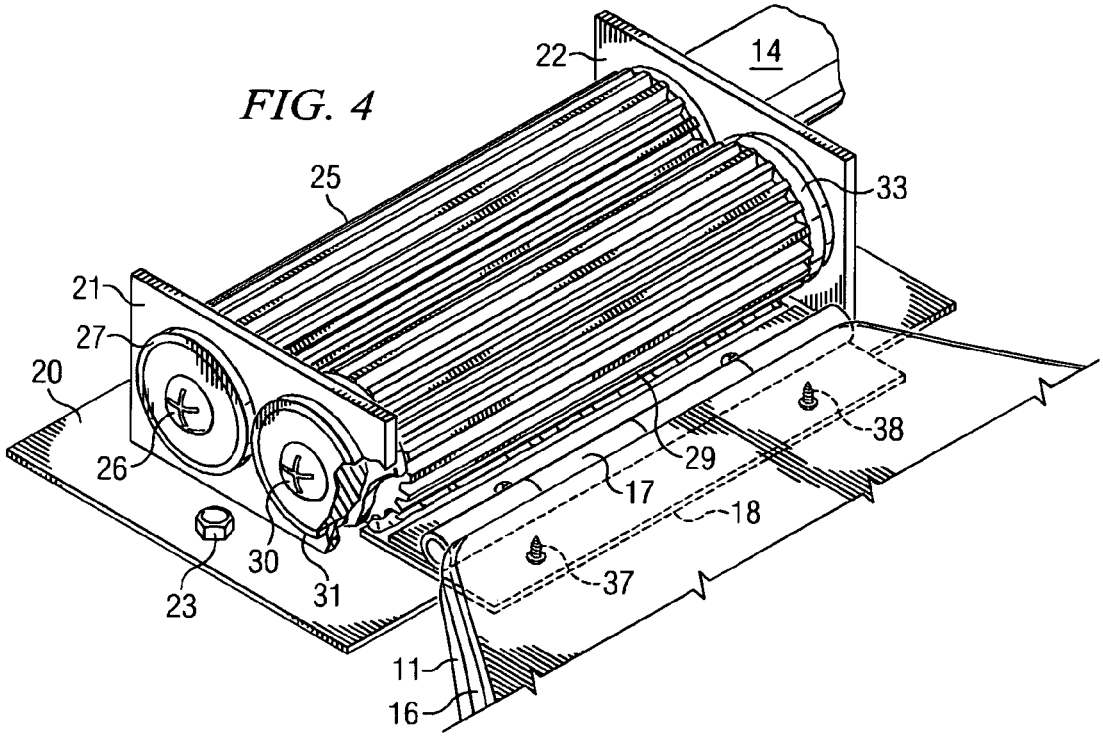
FIG. 4 is a second perspective view of the mechanism of FIG. 3.

FIG. 3 depicts a front, right perspective view of the foot-operated mechanism 10 with the toilet seat 11 and toilet seat cover 16 in the lowered position. FIG. 4 depicts a front, left perspective view of the foot operated mechanism 10 with the toilet seat 11 and toilet seat cover 16 in the lowered position.

Figure 5:
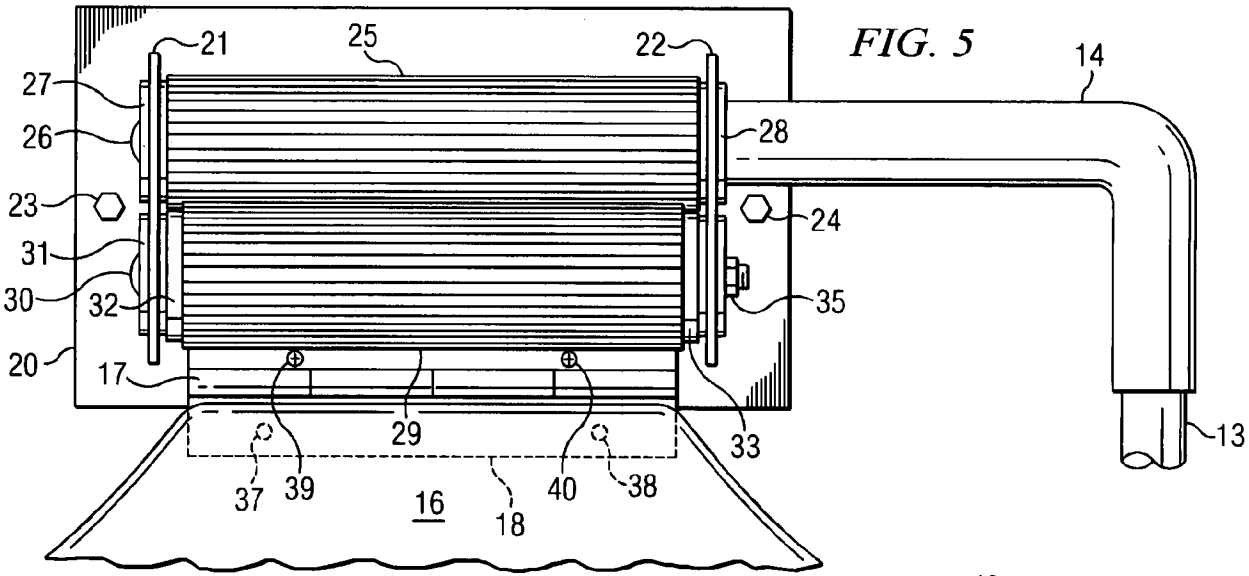
FIG. 5 is a top view of the mechanism of FIG. 3.

FIG. 5 depicts a top perspective view of the foot-operated mechanism 10. The foot-operated mechanism 10 includes a base plate 20 that may be constructed of a metal or other durable material. The base plate 20 includes a left mounting bracket 21 and a right mounting bracket 22 that may also be constructed of a metal or other durable material. The base plate 20 is secured to the toilet between the bowl and the tank with two lock nuts 23 and 24, or other useful fasteners. This positioning of the base plate allows the mechanism 10 to be positioned where it is less likely to be damaged and does not interfere with normal use of the toilet, than for example previous devices that are disposed on the floor or a side of the bowl of the toilet.

A metal rear geared shaft 25 is mounted between the left 21 and right 22 mounting brackets with a steel rear threaded bolt 26 running through the left mounting bracket 21 and a left rear bearing 27. The rear threaded bolt 26 continues through the center of the rear geared shaft 25 and then through a right rear bearing 28 and right mounting bracket 22, threading into the upper lever's 14 threaded recess. A left rear bearing 27 is recessed in the left mounting bracket 21 and a right rear bearing 28 is recessed into the right mounting bracket 22 for supporting the rear geared shaft 25. The rear geared shaft 25 features a female geared recess on the right side, where a male end of the upper lever 14 fits into it, such that a depression of the foot pedal 12 provides torque to the rear geared shaft 25.

The rear geared shaft 25 meshes with a metal front geared shaft 29, such that a rotation of the rear geared shaft 25 causes rotation of the front geared shaft 29. The front geared shaft 29 is mounted in front of the rear geared shaft 25 and between the left and right mounting brackets 21 and 22 by a steel front threaded bolt 30. The front threaded bolt 30 runs through the left mounting bracket 21 and a left front bearing 31, then through a left friction bushing 32. The front threaded bolt 30 then continues through the front geared shaft 29, through a right friction bushing 33, a right front bearing 34 and then the right mounting bracket 22, terminating in a lock nut 35. The left front bearing 31 is recessed in the left mounting bracket 21 and the right front bearing 34 is recessed in the right mounting bracket 22 for supporting the front geared shaft 29. The left 32 and right 33 friction bushings can be constructed of plastic or polyurethane, or any compressible and durable substance or other known apparatus that will provide a damping effect to or friction against the rotation of the metal front geared shaft 29. In certain embodiments, the friction is adjustable by tightening or loosening the front threaded bolt 30.

The toilet seat 11 is connected to the front geared shaft 29 by the metal flange 18. The metal flange 18 is secured to the front geared shaft 29 in a position that does not interfere with the rear geared shaft 25. The toilet seat 11 is mounted on top of the flange 18, which is welded to a position on the front geared shaft 29. The flange 18 is secured by providing two self-tapping screws 37 and 38, or other useful fasteners or attachment methods, into the bottom of the toilet seat 11. The toilet seat cover's hinge 17 is secured to the top of the flange 18 with two machined screws 39 and 40, or otherwise fastened or attached thereto.

The described components cooperate together in the following manner to facilitate raising and lowering the toilet seat. As the user applies foot pressure to the foot pedal 12, the lower lever 13 and upper lever 14 cooperatively provide torque to cause the rear geared shaft 25 to rotate in a direction toward the front geared shaft 29. Due to the engagement of the rear geared shaft 25 with the front geared shaft 29, this rotation causes the front geared shaft 29 to rotate in the opposite direction toward the rear geared shaft 25, thus lifting the metal flange 18 and the toilet seat 11 into the raised position, substantially 90 degrees from the toilet bowl. When the user releases foot pressure to the foot pedal 12, gravity causes the toilet seat 11 to move back to its lowered position, dampened by the left friction bushing 32 and the right friction bushing 33 on both sides of the front geared shaft 29. The toilet seat cover 16, rides on the toilet seat as it is lifted into the raised position and lowered back to the lowered position. It may also be left in a raised position by lifting it beyond 90 degrees from the toilet seat 11. With the toilet seat cover 16 in this position, the toilet seat 11 will raise and lower independently of the toilet seat cover 16.

Figure 6:
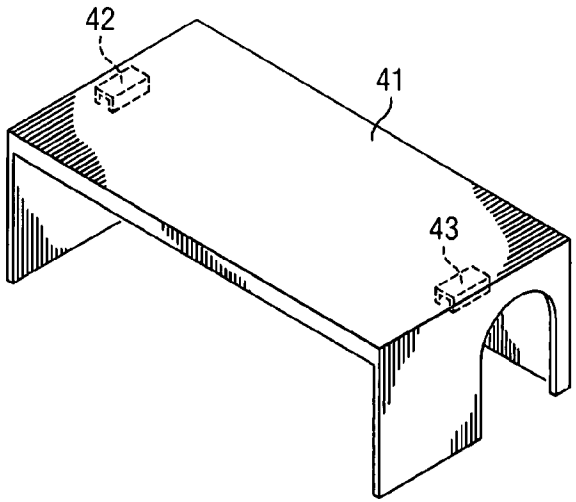
FIG. 6 is a perspective view of a decorative plastic cover for the mechanism of FIG. 3.

FIG. 6 depicts a decorative plastic cover 41 that fits over the foot operated mechanism 10 with adequate apertures for the upper lever and toilet seat 11 and toilet seat cover 16 to operate. The cover is constructed to fit snuggly over the left 21 and right 22 mounting brackets, utilizing a pair of plastic clips 42 and 43 built into the underside of the top and aligned with the top centers of the left 21 and right 22 mounting brackets to hold it in place.

The foot operated mechanism 10 may be manufactured in a left side version where the foot pedal 12 is disposed on the left side of the toilet, as opposed to the right side as shown in FIGS. 1–5. In addition, a foot pedal 10, lower lever 13 and upper lever 14 may simultaneously be provided on both the left and right sides of a toilet.

The rear geared shaft 25 and front geared shaft 29 may be provided in a 1:1 gear ratio, or in certain embodiments may be provided in a 2:1 ratio, or other useful gear ratio, to lessen the force needed to raise the toilet seat 16 with the foot pedal 12.

Various alternate embodiments are readily contemplated. For example, it is contemplated that bearings 27, 28, 31, 34 and/or screws 38, 39 may be omitted, or that alternate equivalent components may be substituted therefore. Also, a single lever may be provided in place of lower lever 13 and upper lever 14.

In a further alternate embodiment, the rear geared shaft 25 and/or the front geared shaft 29 may not be geared continuously across its length as shown in FIGS. 3–5. In such embodiments, one or more individual gears may, for example, be cooperatively disposed along the length of the threaded bolts 26, 30. Such individual gears may have a threaded opening in the center thereof for engaging the threaded bolts 26, 30, thus allowing the gears to be spun along the length of a bolt 26, 30 to a desired position. The flange may then be welded or otherwise secured to the individual gear or gears disposed in place of the front geared shaft 29.

In another alternate embodiment, the rear threaded bolt 26 may be disposed in the opposite direction than as shown in FIGS. 4 and 5, while the front threaded bolt 30 remains in the orientation shown. In this exemplary embodiment, the upper lever 14 may be welded or otherwise secured directly to the head of the rear threaded bolt 26.

The components described herein can be constructed of any material that is both strong and durable. The base plate 20, flange 18, threaded bolts 26, 30, two geared shafts 25, 29, screws 37, 38, nuts 24, 35, bearings 28, 34 and upper lever 14 should be constructed of metal, as these parts support the weight of the toilet seat and will require strength. The lower lever 13 and foot pedal 12 may be constructed of metal or a composite material with high strength. The toilet seat 11 and seat cover 16 may be constructed of plastic or any other lightweight high strength material. The decorative cover 41 may be constructed of plastic or other lightweight material. The present disclosure may be finished in any color or powder coat finish to match any décor. Brushed metal and chromed finishes are also possible. Other minor decorative changes and derivatives that do not affect the operation of the present disclosure are possible are well.

Although the best methodologies of the invention have been particularly described in the foregoing disclosure, it is to be understood that such descriptions have been provided for purposes of illustration only, and that other variations both in form and in detail can be made thereupon by those skilled in the art without departing from the spirit and scope of the present invention, which is defined first and foremost by the appended claims.

What is claimed is:

1. A method for adjusting a position of a toilet seat of a toilet having a left side, a right side, a bowl disposed between the left side and the right side toward a front of the toilet, and a tank disposed between the left side and the right side toward a rear of the toilet, the method comprising:

depressing a foot operated lever to raise a toilet seat, the foot operated lever attached to a first geared shaft that rotates a second geared shaft, the first and second geared shafts disposed between the tank and the bowl of the toilet, the first and second geared shafts secured between a first bracket disposed on the left side of the toilet and a second bracket disposed on the right side of the toilet, the second geared shaft having a flange attached to the toilet seat; and releasing the foot operated lever to lower the toilet seat.

2. An apparatus for adjusting a position of a toilet seat of a toilet having a left side, a right side, a bowl disposed between the left side and the right side toward a front of the toilet, and a tank disposed between the left side and the right side toward a rear of the toilet, the apparatus comprising:

a first bracket and a second bracket for being disposed between a tank and bowl of a toilet, the first bracket further for being disposed on a left side of the toilet and the second bracket further for being disposed on a right side of the toilet;

a first geared shaft, disposed between the first and second brackets closer to the tank than the bowl, the first geared shaft operative to rotate in response to a depression of a lever disposable on either a left end or a right end of the first geared shaft;

a second geared shaft, disposed between the first and second brackets closer to the bowl than the tank, and operatively engaged with the first geared shaft such that a rotation of the first geared shaft causes a rotation of the second geared shaft; and a flange secured along the second geared shaft, the flange for attachment to a toilet seat to adjust a position thereof in response to the rotation of the second geared shaft.

3. The apparatus of claim 2, further comprising:

a lever attached to one side of the first geared shaft.

4. The apparatus of claim 3, the lever further comprising an upper portion and a separate lower portion of smaller diameter for fitting within an end of the upper portion.

5. The apparatus of claim 4, the upper portion including a screw disposed to secure the lower portion at a desired position within the upper portion.

6. The apparatus of claim 3, the lever further comprising a foot pedal.

7. The apparatus of claim 6, wherein the foot pedal is disposed above a floor when the apparatus is mounted to the toilet.

8. The apparatus of claim 2, further comprising:

a plate for placement on the toilet between the bowl and the tank; and the first and second brackets disposed on the plate for securing the first geared shaft and the second geared shaft on the toilet.

9. The apparatus of claim 2, wherein the first geared shaft and the second geared shaft have a 1:1 gear ratio.

10. The apparatus of claim 2, wherein the first geared shaft and the second geared shaft have a 2:1 gear ratio.

11. The apparatus of claim 2, further comprising:

a bushing disposed on a bolt of the second geared shaft in contact with the first bracket, for dampening a rotation of the second geared shaft.

12. The apparatus of claim 2, further comprising:

a toilet seat and a toilet seat cover secured to the flange.

13. The apparatus of claim 2, further comprising:

a toilet having a bowl and a tank, the first geared shaft and the second geared shaft disposed between the tank and the bowl.

14. The apparatus of claim 2, further comprising:

a cover for enclosing the first geared shaft and the second geared shaft.

15. A toilet having a left side, a right side, a bowl disposed between the left side and the right side toward a front of the toilet, a toilet seat positioned over the bowl, and a tank disposed between the left side and the right side toward a rear of the toilet, the toilet further comprising:

a foot operated mechanism disposed between a tank and a bowl of the toilet, the foot operated mechanism comprising:

a first bracket disposed on the left side of the toilet;

a second bracket disposed on the right side of the toilet;

a first geared shaft disposed between the first and second brackets closer to the tank than the bowl and having a lever disposed on at least one side for providing torque to rotate the first geared shaft;

a second geared shaft disposed between the first and second brackets closer to the bowl than the tank and operatively engaged with the first geared shaft such that a rotation of the first geared shaft in a first direction causes a rotation of the second geared shaft in an opposite direction; and a flange secured along the second geared shaft, the flange further attached to the toilet seat for adjusting a position thereof over the bowl in response to the rotation of the second geared shaft.

* * * * *